United States Patent [19]

Kohyama

[11] 4,322,156

[45] Mar. 30, 1982

[54] CHARGING APPARATUS FOR COPYING MACHINE

[75] Inventor: Mitsuaki Kohyama, Higashikurume, Japan

[73] Assignee: Tokyo Shibaura Denki Kabushiki Kaisha, Kawasaki, Japan

[21] Appl. No.: 169,100

[22] Filed: Jul. 15, 1980

[30] Foreign Application Priority Data

Aug. 14, 1979 [JP] Japan ..... 54-103262
Aug. 14, 1979 [JP] Japan ..... 54-103263
Aug. 14, 1979 [JP] Japan ..... 54-111761[U]

[51] Int. Cl.[3] ..... G03G 15/00; H01H 47/32; H01T 19/04

[52] U.S. Cl. ..... 355/3 CH; 250/324; 250/326; 355/14 CH; 361/212; 361/229

[58] Field of Search ..... 355/3 R, 3 TE, 3 CH, 355/3 SH, 3 TR, 14 CH; 361/212, 229, 230; 250/324, 325, 326

[56] References Cited

U.S. PATENT DOCUMENTS 3,457,405 7/1969 Del Vecchio et al. ..... 361/230
3,762,811 10/1973 Matsumoto ..... 355/3 R
3,805,069 4/1974 Fisher ..... 250/326
3,976,880 8/1976 Brunelle et al. ..... 361/229 X
3,976,881 8/1976 Parker ..... 250/324
4,208,697 6/1980 Fischer et al. ..... 355/3 CH X
4,252,431 2/1981 Cormier ..... 355/3 CH

FOREIGN PATENT DOCUMENTS 2021407 11/1971 Fed. Rep. of Germany ..... 250/324
54-22305 8/1979 Japan .

*Primary Examiner*—Fred L. Braun
*Attorney, Agent, or Firm*—Schuyler, Banner, Birch, McKie & Beckett

[57] ABSTRACT

In an electrostatic copying machine, a charging apparatus for a photoconductive member includes a thermally responsive device for automatically adjusting the distance between the corona charger and the photoconductive member in response to temperature changes in the photoconductive member. Therefore, the charge accepted by the photoconductive member is maintained at a substantially uniform level despite the temperature variations of the photoconductive member.

9 Claims, 9 Drawing Figures

CHARGING APPARATUS FOR COPYING MACHINE

BACKGROUND OF THE INVENTION

This invention relates to a charging apparatus for an electrostatic copying machine.

In a typical copying machine, a photoconductive member such as a photoconductive drum is uniformly charged and then exposed with a light image corresponding to an original document to form an electrostatic image on the photoconductive member. A developer is applied to the drum to develop the electrostatic image into a visible toner image which is transferred and fixed to a sheet of paper.

It is well known that the charge acceptance of the photoconductive member in an electrostatic copying machine changes with temperature. Unfortunately, as the charge acceptance varies with temperature, the quality of the copy image or reproduction is affected.

For example, FIG. 1 shows a graph of charge acceptance versus temperature for a photoconductive member under constant luminance. The data in this graph was obtained by charging a photoconductive member formed by an alloy of selenium and tellurium with a corona charger under constant voltage. The ordinate shows the charge acceptance (V) and the abscissa shows the temperature (T° C.) of the atmosphere surrounding the photoconductive member. The shaded portion is the permissible charge acceptance range for quality reproductions. It can be seen from this graph that, above 35° C., the charge acceptance (V) decreases with temperature. Moreover, temperatures above 45° C. are outside the permissible charge acceptance range. In other words, with temperature above 45° C. and constant luminance, excessive exposure occurs which results in poor reproduction quality. This occurs because the electrical resistance of the photoconductive member is reduced with an increase in temperature which reduces the charge acceptance of the photoconductive member. Accordingly, it is necessary to control the charging of the photoconductive member by the corona charger in order to enhance reproduction quality.

In U.S. Pat. No. 3,805,069 issued to Donald H. Fisher on Apr. 16, 1974, a charging apparatus is disclosed which contains a thermistor for detecting the temperature of the photoconductive member and generating a signal representing the detected temperature. This signal is utilized to control the high voltage to the corona charger. However, such prior art charging apparatus have many disadvantages including unreliability, complicated construction and high cost.

SUMMARY OF THE INVENTION

It is an object of the present invention to provide an electrostatic copying machine which overcomes the disadvantages of conventional charging apparatus by utilizing a simpler structure.

It is a further object of the present invention to provide an electrostatic copying machine wherein higher quality reproductions are obtained over a broader temperature range.

According to the present invention, compensation for temperature variations is produced by varying the position of the corona charger relative to the photoconductive member. A thermal device is operatively connected to the corona charger for automatically adjusting the distance between the corona charger and the photoconductive member in response to the temperature of the photoconductive member.

DETAILED DESCRIPTION OF THE PREFERRED EMBODIMENT

Figure 3:
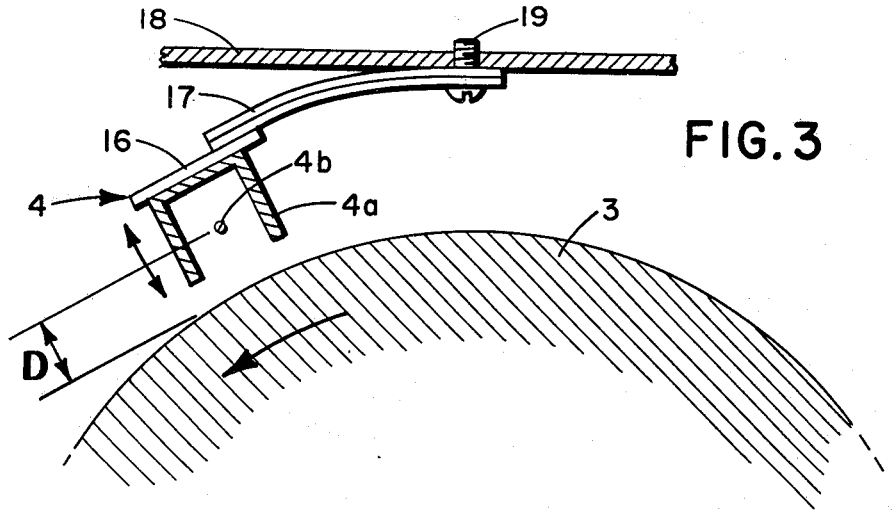
FIG. 3 is a partial longitudinal sectional view showing one embodiment of the invention.
Figure 2:
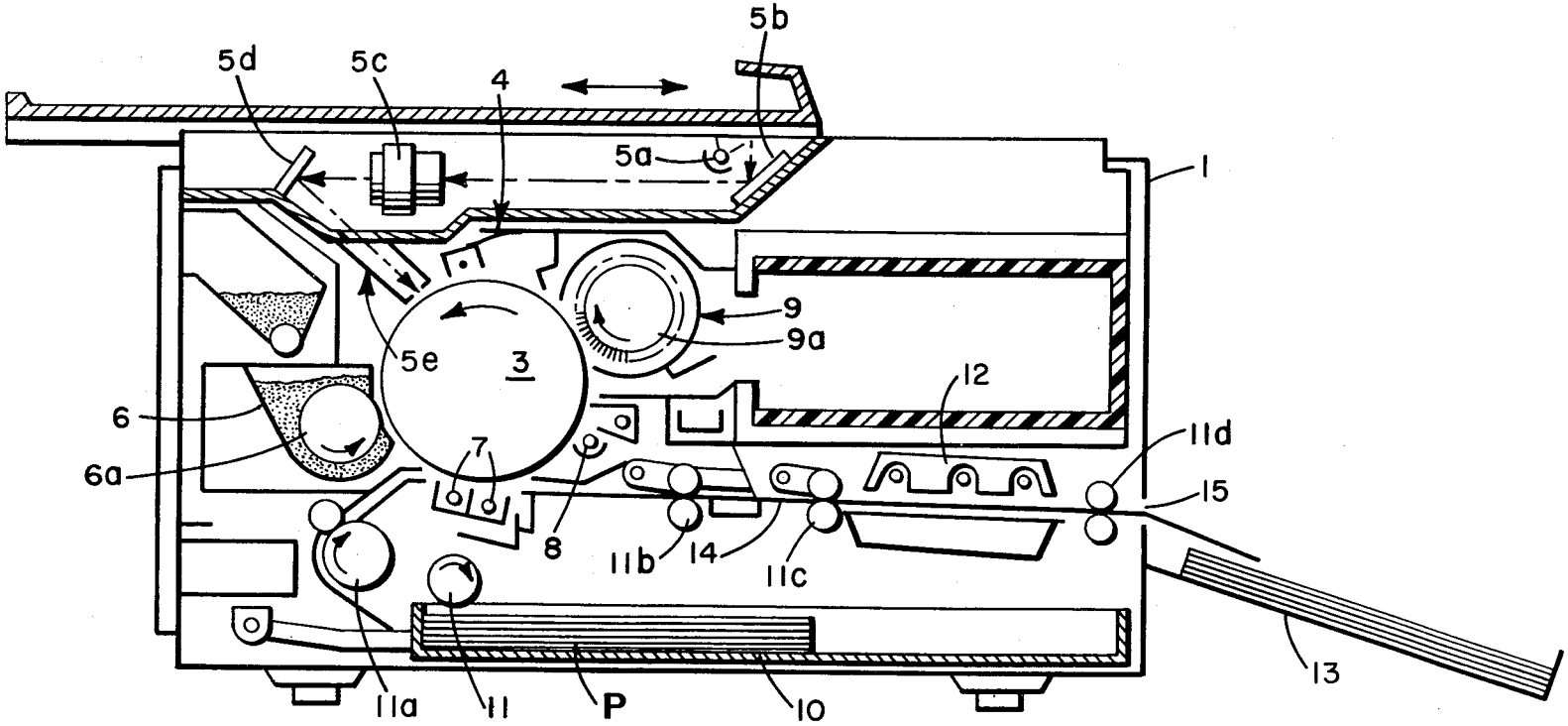
FIG. 2 is a schematic view showing the present invention positioned within an electrostatic copying machine.

Referring now to FIGS. 2–3, an explanation will be given regarding a preferred embodiment of the invention. As shown in FIG. 2, the electrostatic copying machine of the invention comprises a photoconductive drum 3, a corona charger 4, an exposure device 5 and a developing device 6. The photoconductive drum 3 is disposed in a main body 1 of the electrostatic copying machine and linked to an appropriate drive means (not shown) to rotate in the direction indicated by the arrow. The photoconductive drum 3 is a photoconductive medium made of amorphous selenium, zinc oxide, etc. A reciprocating table 2 is provided on the main body 1 for holding an original document to be copied. The corona charger 4 is provided adjacent the drum 3 for applying a uniform electrostatic charge to the photoconductive drum 3. The exposure device 5 is positioned at the upper portion of the main body 1 for exposing the charged photoconductive drum 3 so as to produce an electrostatic latent image on the drum 3. The exposure device comprises an exposure lamp **5*a*, a first mirror 5*b*, a lens unit 5*c*, a second mirror 5*d* and a light guide 5*e*. The developing device 6 includes a magnetic roller 6*a*** for developing the electrostatic latent image.

A corona charger 7 is located below the drum 3 for transferring the developed image to a sheet of paper P. Another corona charger 8 is provided adjacent drum 3 for removing the residual charge by applying a corona charge of opposite polarity to the polarity of the electrostatic latent image. A cleaning device 9 is provided adjacent drum 3 for removing the residual toner. Removal of residual toner is accomplished by the rotation of a fur brush **9*a* against drum 3. Cassette 10 contains paper P and a sheet feed roller 11 contacts each sheet of paper P to move the sheet along a sheet path 14. Positioned along path 14 are sheet transport rollers 11*a*, 11*b*, 11*c* and 11*d* to move the sheet of paper along sheet path 14. A fixing device 12 is provided at the end of the sheet path 14 for fixing the toner image which is transferred to the sheet from the drum 3. A tray 13 is attached at the outside of the main body 1 and adjacent a sheet outlet 15** for receiving the sheet of paper as it is discharged from the copying machine.

FIG. 3 shows the detailed structure of the charging apparatus according to this invention. The charging apparatus comprises the corona charger 4 and a thermal means or a bimetal plate 17. The corona charger 4 consists of a conductive shield 4*a* preferably made of aluminum or stainless steel. The shield 4*a* is generally inverted and U-shaped. The corona charger 4 includes a coronode wire 4*b* which functions as a discharge electrode. Preferably, the coronode wire 4*b* is made from any suitable non-corrosive material such as stainless steel, platinum, or tungsten having a tungsten oxide coating thereon. The wire has a substantially uniform diameter of approximately 80 μm. The coronode wire 4*b* extends longitudinally along the length of the shield 4*a* and is connected at both ends to suitable dielectric blocks made of insulating material and attached to opposite ends of the shield 4*a*. The open side of the U-shaped shield 4*a* faces the photoconductive drum 3 so that the coronode wire 4*b* extends along the outer periphery of the drum 3 in the axial direction at a predetermined distance D. The closed side of the shield 4*a* is attached to the bimetal plate 17 by an insulating plate 16. One end (i.e., the free or unattached end) of the bimetal plate 17 is connected to the insulating plate 16 and this other end of the bimetal plate 17 is fixed to the frame 18 by a screw 19. The bimetal plate 17 consists of laminated invar and bronze plates welded together. The free end of the bimetal plate 17 which is connected to the corona charger 4 is bendable due to thermal metamorphosis. When the temperature of the photoconductive drum 3 increases, the bimetal plate 17 will bend counterclockwise so that the corona charger 4 will approach the surface of the drum 3. When the temperature of the photoconductive drum 3 decreases, the bimetal plate 17 will bend clockwise so that the corona charger 4 will move away from the surface of the drum 3.

Figure 4:
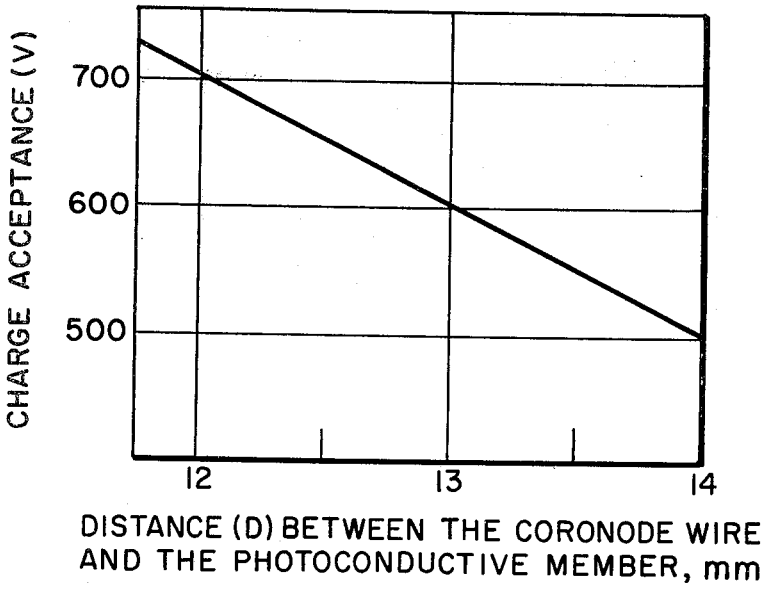
FIG. 4 is a graph showing the charge acceptance versus the distance between the coronode wire and the photoconductive member.

Moreover, FIG. 4 shows the discharge characteristic obtained by applying +6.0 KV to the coronode wire 4*a*. In the graph, the ordinate shows the charge acceptance (V) on the photoconductive drum 3 and the abscissa shows the distance (D) between the coronode wire 4*b* and the surface of the drum 3. As shown in this graph, the charge acceptance (V) changes by approximately 100 V with a change in the distance (D) of 1 mm. Therefore, the thermal metamorphosis of the bimetal plate 17 must be set to meet the discharge characteristic shown in FIG. 4. The corona charger 4 is displaced by the bimetal plate 17 in the direction of charge emission of the corona charger 4.

The operation of the electrostatic copying machine of the above embodiment will now be described. An original document is placed on the table 2 and a copying switch (not shown) is turned on. By turning on the copying switch, the drive unit (not shown) drives the photoconductive drum 3. At this time, the photoconductive drum 3 is uniformly charged by the corona charger 4. As the table 2 moves towards the right, the exposure lamp 5*a* lights. As a result, the light image of the original document travels through first mirror 5*b*, lens unit 5*c*, second mirror 5*d* and the light guide 5*e*. The light then strikes the charged portion of the drum 3 to form an electrostatic latent image. Subsequently, developer is applied to the electrostatic latent image by the magnetic roller 6*a* of the developing device 6 to form a toner image. The toner image is then transferred by the corona charger 7 onto the sheet of paper P supplied by the feed roller 11 and transport roller 11*a* from sheet cassette 10. Thereafter, the sheet of paper P is transported by sheet transport rollers 11*b* and 11*c* to fixing device 12 where the toner image is fixed. Upon completion of this step, the sheet is then discharged by roller 11*d* onto tray 13. The residual charge on drum 3 finally is removed by the corona charger 8 and the residual toner is removed by rotary fur brush 9*a* of cleaning device 9.

Figure 1:
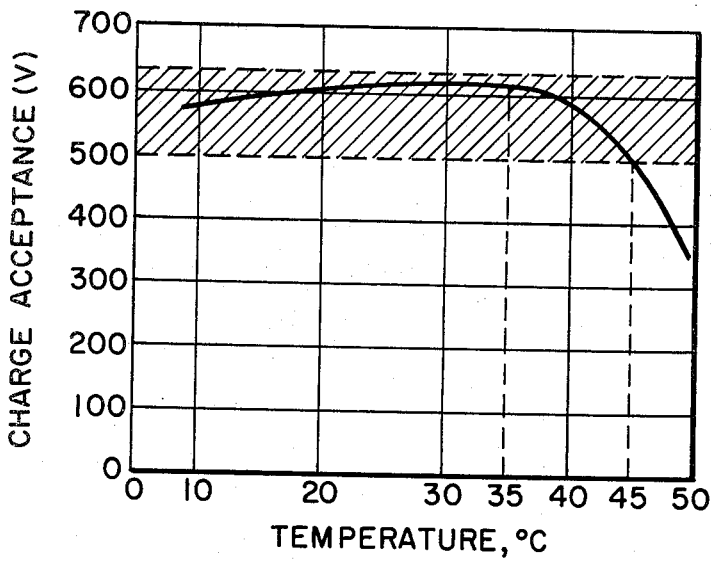
FIG. 1 is a graph showing charge acceptance versus the temperature of the photoconductive member.

When the temperature of the atmosphere surrounding the photoconductive drum 3 gradually increases (e.g., 45° C. in FIG. 1) during the copying process, the charge acceptance of the drum decreases (e.g., 500 V in FIG. 4). The temperature increase can be due to the atmospheric condition in the location of the copying machine or the heat generated by the fixing device 12. In any event, as the temperature increases, the bimetal plate 17 is rotationally displaced in the counterclockwise direction about its secured end. This displacement of the bimetal plate 17 reduces the distance D by about 1 mm between the coronode wire 4*b* and the surface of the drum 3. Thus, the charge acceptance increases from 500 V to 600 V. Therefore, even if the temperature of the drum 3 is increased to cause an unacceptable reduction in the charge acceptance (V), the charging potential of the corona charger 4 can always be adjusted to the proper charge acceptance range by the thermal displacement of the bimetal plate 17 to thereby obtain uniform reproduction quality over wide temperature variations.

Figure 5:
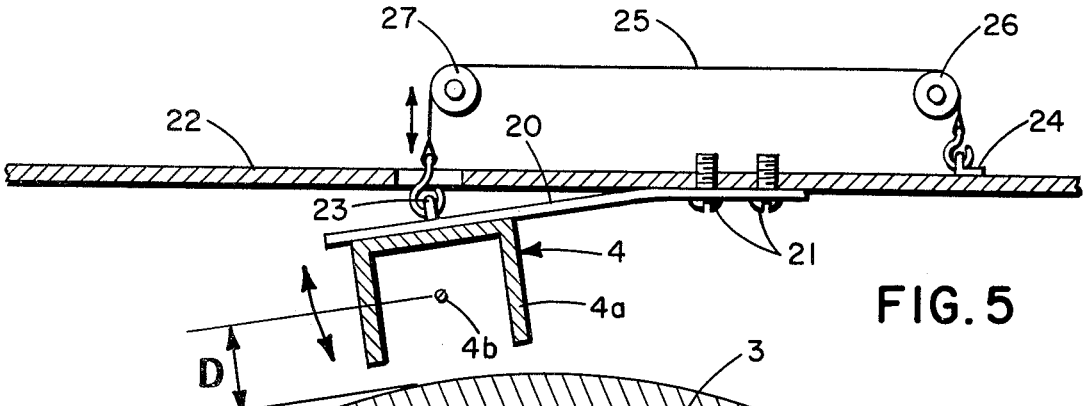
FIG. 5 is a partial longitudinal sectional view showing a second embodiment of the invention.

In FIG. 5 a second embodiment of the charging apparatus of the present invention is shown. One end of a spring plate 20 is fixed on a frame 22 by screws 21 and the other end (i.e., free end) of the spring 20 is connected to shield 4*a* of corona charger 4. The spring 20 biases the corona charger 4 to move in a counterclockwise direction. A hook 23 is provided on the free end of the spring plate 20 and a hook 24 is provided on the frame 22. A thermal metallic wire 25 is provided between the hooks 23 and 24. The metallic wire 25 is connected from the hook 23 over rollers 27 and 26 and to the hook 24 so that the corona charger 4 is urged to move in a clockwise direction by the metallic wire 25. As a result, under normal temperature conditions, the tension of the spring plate 20 and the metallic wire 25 are balanced to properly set the distance D for quality reproductions.

The metallic wire 25 has particular thermal characteristics and it is responsive to the charge in the temperature of the photoconductive drum 3. The length of the metallic wire 25 changes in accordance with its coefficient of thermal expansion. Thus, when the temperature of the photoconductive drum 3 increases, the metallic wire 25 will expand to rotate the corona charger 4 counterclockwise due to the force exerted by the spring plate 20 to thereby reduce the distance D. Conversely, as the temperature decreases, the corona charger 4 will rotate clockwise due to the force exerted by the metallic wire 25 to thereby increase the distance D.

Figure 6:
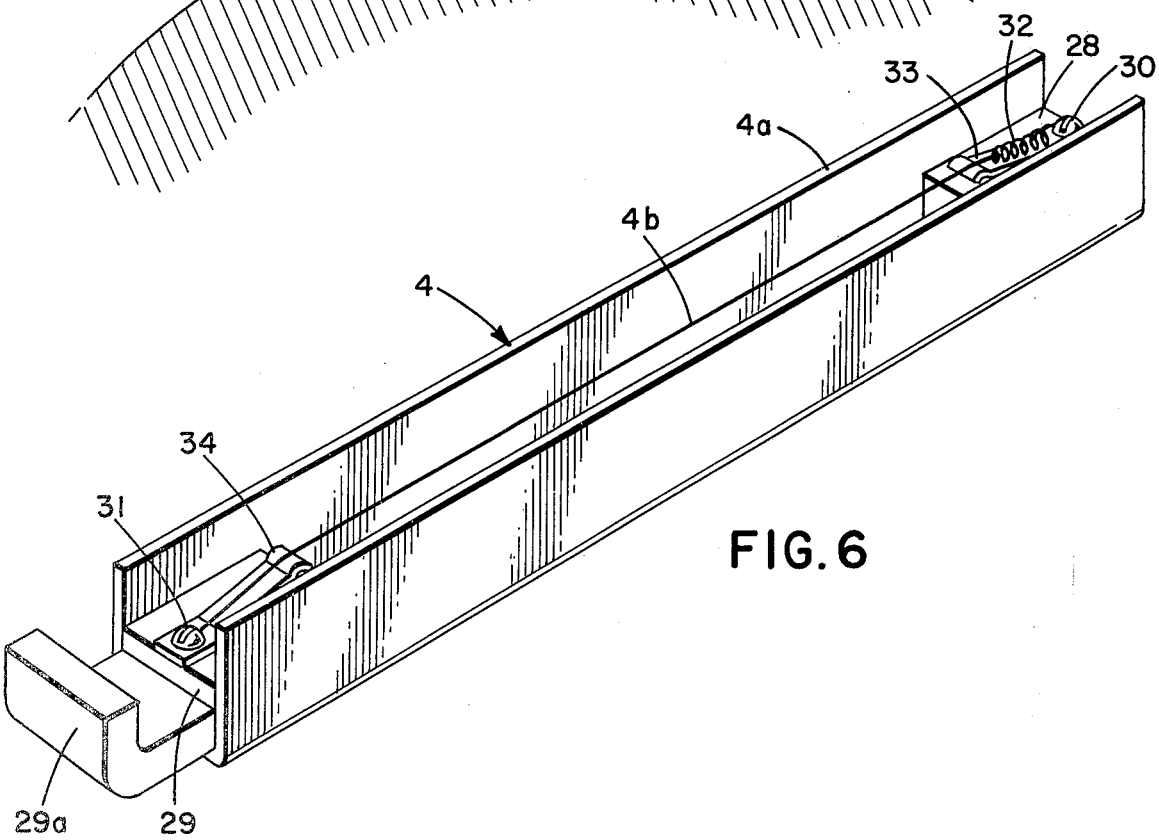
FIG. 6 is a perspective view showing a third embodiment of the invention.
Figure 7:
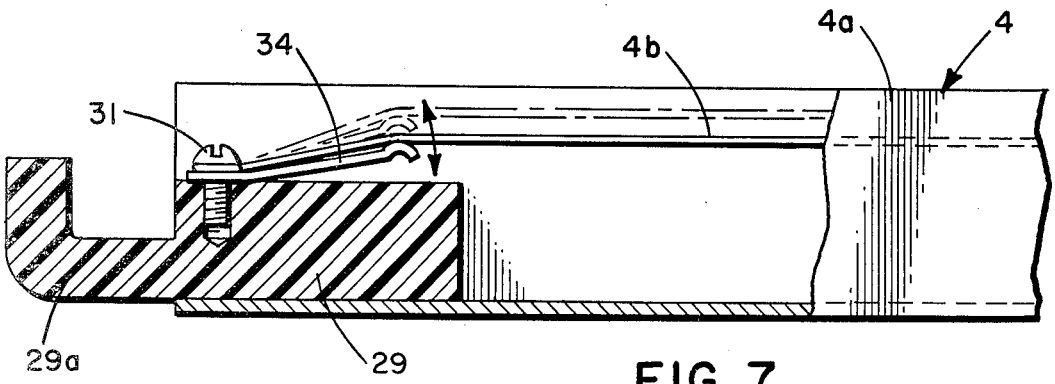
FIG. 7 is a sectional view of FIG. 6.

In FIGS. 6 and 7, a third embodiment of a charging apparatus is shown. A pair of dielectric blocks 28 and 29, which are made of insulating material, are attached to opposite ends of the shield 4*a*. A coronode wire 4*b* extends longitudinally along the length of the shield 4*a* and is connected at blocks 28 and 29 by screws 30 and 31, respectively. One end of the wire 4*b* is screwed to the block 28 by the screw 30 via a spring 32 and the other end of the wire 4b is screwed to the block 29 by the screw 31. Bimetal elements 33 and 34 are also secured by screws 30 and 31 in a cantilever state such that they each support an end portion of the coronode wire 4b. The free ends of these bimetal elements 33 and 34 provide tension to the wire 4b. A handle 29a is provided integrally with the block 29 for attaching the corona charger 4 to the copying machine. The open side of the U-shaped shield 4a faces the photoconductive drum 3 so that the coronode wire 4b extends along the outer periphery of the drum 3 at a predetermined distance D therefrom.

In the embodiment of FIGS. 6–7, when the temperature of the photoconductive drum 3 increases, bimetal elements 33 and 34 will bend upwardly such as shown by broken lines in FIG. 7. Consequently, the coronode wire 4b will be moved toward drum 3 so that the distance D will be decreased.

Figure 8:
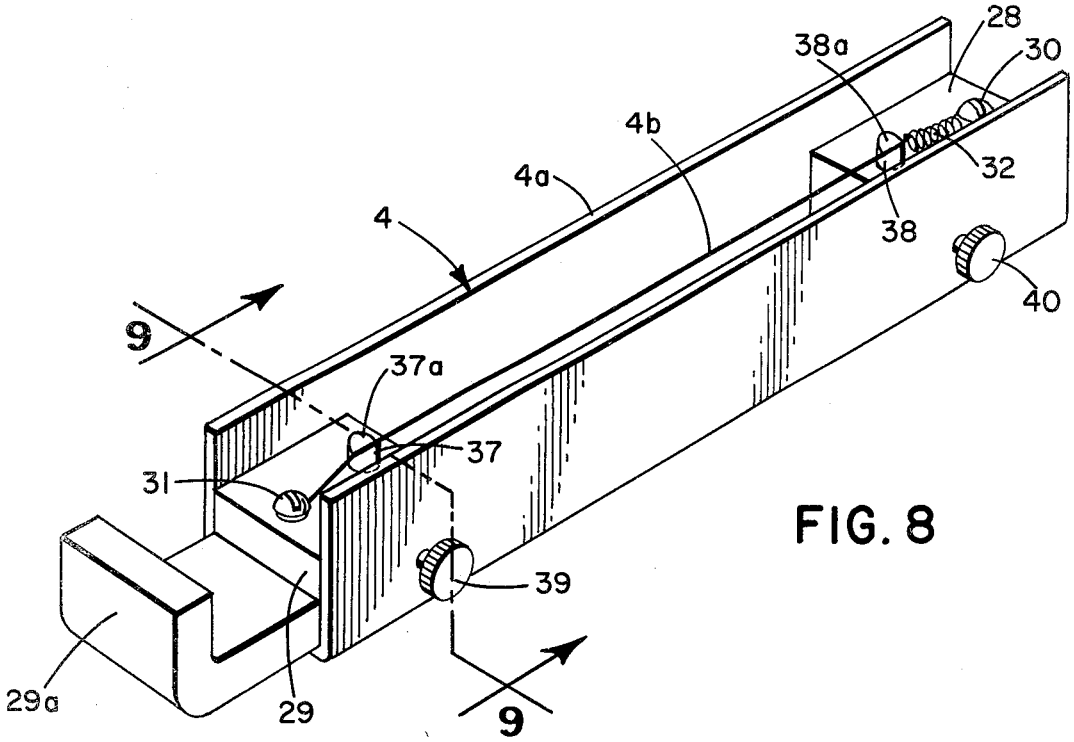
FIG. 8 is a perspective view showing a fourth embodiment of the invention.
Figure 9:
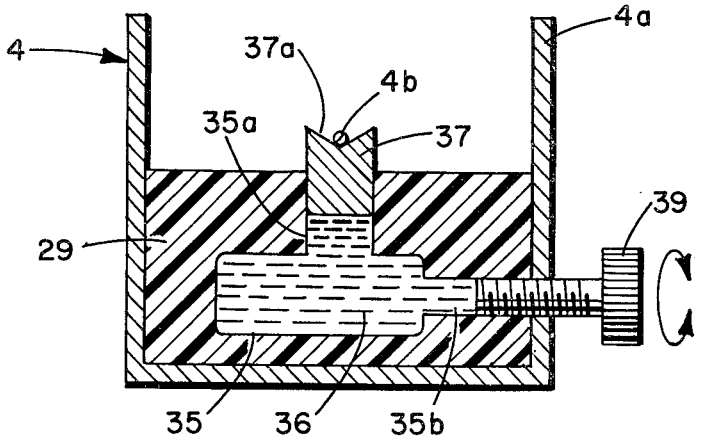
FIG. 9 is a sectional view taken along line 9—9 of FIG. 8.

Finally, in FIGS. 8 and 9, a fourth embodiment of a charging apparatus is shown. The elements which are identical to elements described above with respect to FIGS. 6 and 7 are given the same reference number so that no further explanation of these elements is necessary. Blocks 28 and 29 include an inner liquid chamber 35 containing a liquid 36 capable of expansion or contraction in response to temperature changes. The liquid 36 could be methyl alcohol, mercury, carbon tetrachloride or glycerine. One end of the liquid chamber 35 includes a first opening 35a which opens to the open side of the shield 4a. A second opening 35b opens adjacent one side wall of the shield 4a. Holders 37 and 38 having V-shaped grooves 37a and 38a, respectively are fitted and sealed in each opening 35a. The grooves 37 and 38a of the holders 37 and 38 support corresponding end portions of the coronode wire 4b. The holders 37 and 38 also apply tension to the coronode wire 4b. Adjustment knobs 39 and 40 are screwed in each opening. The initial position of the coronode wire 4b is set by appropriately setting the adjustment knobs 39 and 40. The open side of the shield 4a faces the photoconductive drum 3 so that the coronode wire 4b extends along the outer periphery of the drum 3 at a predetermined distance D.

In operation, when the temperature of the photoconductive drum 3 increases, the liquid 36 in the liquid chamber 35 expands to move the holders 37 and 38 upward. The coronode wire 4b is thereby moved toward drum 3 so that the distance D will be decreased. Of course, as described above in the other embodiments, this movement of the coronode wire 4b adjusts the charge acceptance of the photoconductive drum and thereby controls the reproduction quality.

I claim:

1. In an electrostatic copying machine, a charging apparatus for charging a photoconductive member, wherein the charge acceptance of said photoconductive member is dependent on temperature, said charging apparatus comprising:

a corona charger spaced a predetermined distance from said photoconductive member for charging said photoconductive member; and support means for supporting said corona charger, said support means comprising thermal means positioned near said photoconductive member and operatively connected to said corona charger for adjusting the distance between said corona charger and said photoconductive member in response to the temperature of said photoconductive member.

2. The charging apparatus of claim 1 wherein said thermal means comprises a bimetal plate.

3. The charging apparatus of claim 1 wherein said thermal means comprises a metallic wire.

4. The charging apparatus of claim 1 wherein said corona charger further comprises a shield and a coronode wire extending along said shield member.

5. In an electrostatic copying machine, a charging apparatus for charging a photoconductive member, wherein the charge acceptance of said photoconductive member is dependent on temperature, said charging apparatus comprising:

a corona charger spaced a predetermined distance from said photoconductive member for charging said photoconductive member, said corona charger comprising a shield and coronode wire extending along said shield member; and support means for supporting said corona charger, said support means comprising thermal means positioned near said photoconductive member and operatively connected to said shield for adjusting the distance between said coronode wire and said photoconductive member in response to the temperature of said photoconductive member.

6. The charging apparatus of claim 5 wherein said thermal means comprises a bimetal plate and one end of said bimetal plate is connected to said shield member.

7. The charging apparatus of claim 5 wherein said thermal means comprises a pair of bimetal plates spaced on either end of said shield, said bimetal plates supporting said coronode wire to move said coronode wire relative to said photoconductive member in response to temperature.

8. The charging apparatus of claim 5 wherein said thermal means comprises a metallic wire, one end of said metallic wire being connected to said shield for urging said shield to move in a first direction, said charging apparatus further comprising spring means connected to said shield for urging said shield to move in a second direction opposite to said first direction.

9. In an electrostatic copying machine, a charging apparatus for charging a photoconductive member, wherein the charge acceptance of said photoconductive member is dependent on temperature, said charging apparatus comprising:

a corona charger spaced a predetermined distance from said photoconductive member for charging said photoconductive member, said corona charger comprising a shield and coronode wire extending along the length of said shield; and support means for supporting both ends of said coronode wire, said support means comprising a fluid container mounted at both ends of said shield, a thermally responsive fluid contained within said fluid container and responsive to the temperature of said photoconductive member and a movable holding member mounted on said fluid container for holding said coronode wire, said movable holding member being movable in response to the expansion or contraction of said thermally responsive fluid to move said coronode wire relative to said photoconductive member.

* * * * *